United States Patent [19]

Jaecklin

[11] Patent Number: 5,017,050

[45] Date of Patent: May 21, 1991

[54] BUILDING ELEMENT FOR SUPPORTIVE GRID WALLS WITH A BULK MATERIAL FILLING

[76] Inventor: Felix P. Jaecklin, Geissbergstrasse 46, CH-5400 Ennetbaden, Switzerland

[21] Appl. No.: 24,846

[22] Filed: Mar. 18, 1987

Related U.S. Application Data

[63] Continuation of Ser. No. 721,858, Apr. 9, 1985, abandoned.

[30] Foreign Application Priority Data

Apr. 10, 1984 [DE] Fed. Rep. of Germany ..... 3413479

[51] Int. Cl.[5] ..... E04C 1/39

[52] U.S. Cl. ..... 405/284; 52/608; 47/83

[58] Field of Search ..... 405/284, 287; 47/83; 52/608, 169.7

[56] References Cited

U.S. PATENT DOCUMENTS

| | | | |
|---|---|---|---|
| 2,419,996 | 5/1947 | Honikmann | 52/608 |
| 4,384,810 | 5/1983 | Neumann | 405/284 |
| 4,524,551 | 6/1985 | Scheiwiller | 52/608 |

FOREIGN PATENT DOCUMENTS

| | | | |
|---|---|---|---|
| 0016353 | 10/1980 | European Pat. Off. | 47/83 |
| 0031154 | 1/1981 | European Pat. Off. | 52/169.1 |
| 2420173 | 4/1974 | Fed. Rep. of Germany . | |
| 3106486 | 2/1981 | Fed. Rep. of Germany . | |
| 3103849 | 5/1981 | Fed. Rep. of Germany . | |
| 1333889 | 6/1963 | France | 404/7 |
| 419943 | 11/1934 | United Kingdom | 404/7 |

*Primary Examiner*—James L. Ridgill, Jr.
*Attorney, Agent, or Firm*—Tarolli, Sundheim & Covell

[57] ABSTRACT

In the technical field of supporting grid walls with a bulk material filling, comprising longitudinal and cross beams which form a supporting grid structure, there is a substantial need for beam structure and shaping making possible enhanced connection stability together with a relatively simple and low-cost production of the elements and with simple mounting methods.

The invention solves this problem by providing at least one hole or recess in the cross beam open over a part of its circumferential contour and adapted to receive a longitudinal beam for establishing a form-locking connection between the beams secured against separation and displacement against each other in a mounted state. The contour of the hole or recess overlaps the upper side of the longitudinal beam so as to form an abutment therefor, and is shaped so as to firstly permit a partial lateral insertion of the longitudinal beam while establishing contact between the abutment and the longitudinal beam in a first rotational position of the latter in relation of the cross beam. The shaping of the hole or recess further permits the full insertion of the longitudinal beam while establishing the form-locking connection easily by cross-sectional rotation impossible to be reversed when the structure is under load.

2 Claims, 10 Drawing Sheets

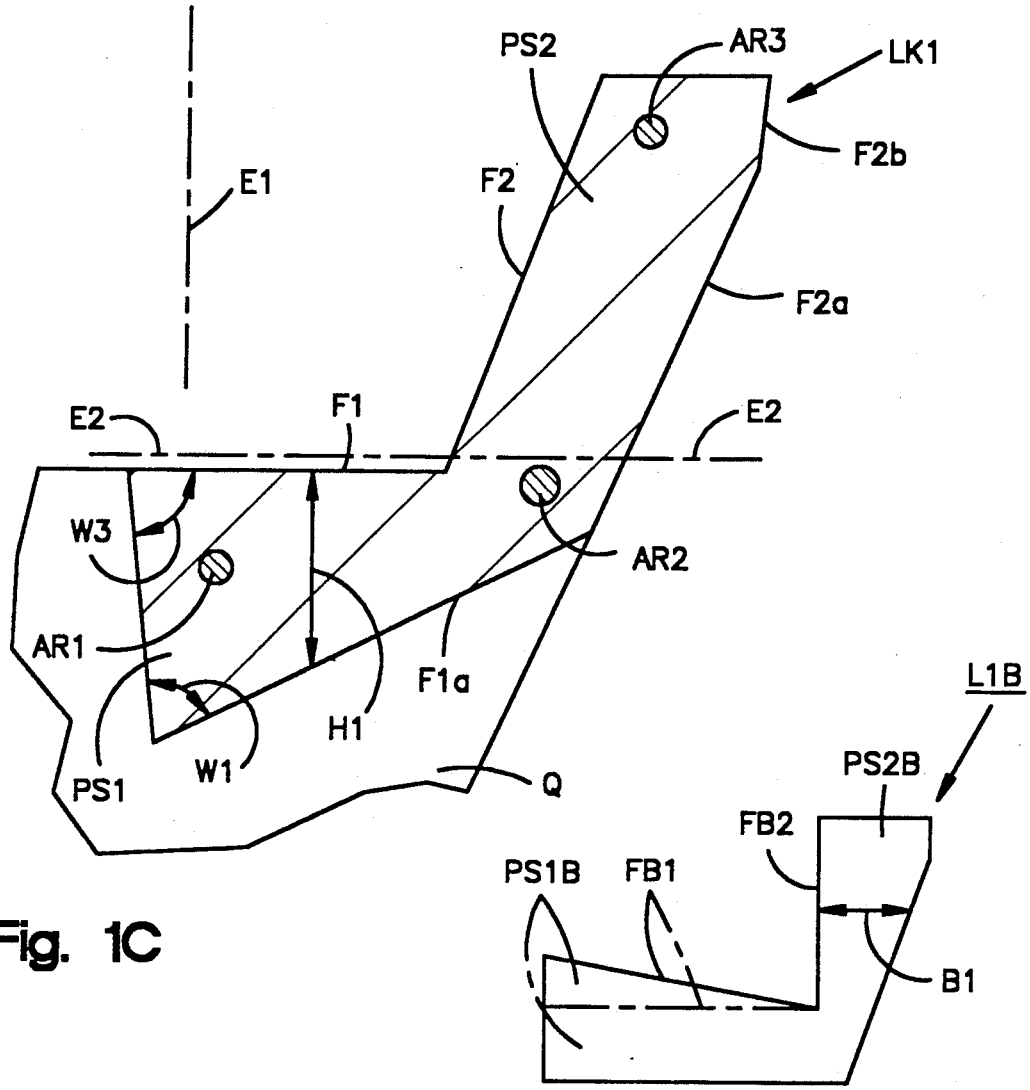
Fig. 1C
Fig. 1B
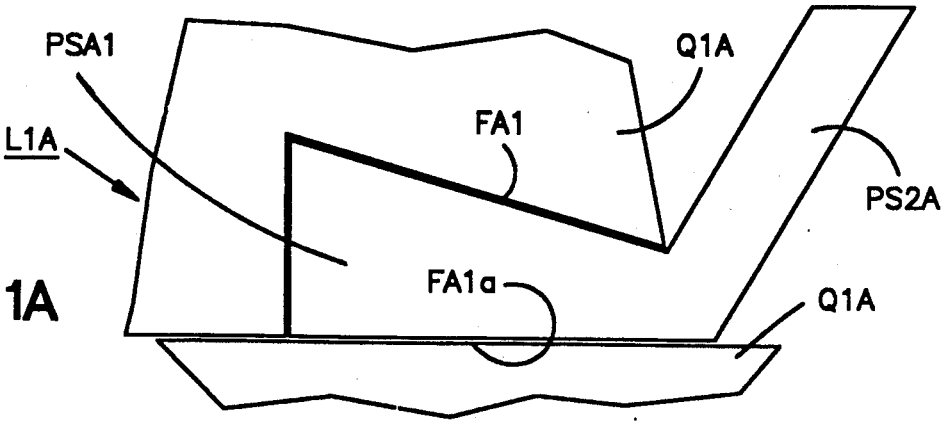
Fig. 1A

BUILDING ELEMENT FOR SUPPORTIVE GRID WALLS WITH A BULK MATERIAL FILLING

This is a continuation of co-pending application Ser. No. 721,858, filed on Apr. 9, 1985, now abandoned.

The invention relates to building elements for supporting grid walls with a bulk material filling. These are particularly frame-like elements comprising at least two sub-elements, preferably in the form of beams arranged at an angle to one another, and connected in a form-locking or material-locking manner. Especially in the case of such sub-elements being connected in a form-locking manner the element may be regarded also as a building element kit from which one or more complete elements can be assembled, particularly in situ. Accordingly the term "building element" is intended to comprise unitary elements as well as multi-part and more complex elements.

In many cases one of sub-elements or beams is constructed as a longitudinal beam extending substantially parallel to the wall plane and comprising at least two profile legs arranged at an angle to one another. The first of these profile are forming at least one bearing surface for the bulk material filling, which bearing surface covers substantially the central part of the longitudinal beam's cross-section, while the second of these profile legs forms a retaining surface for the bulk material filling facing the inside space of the frame and being offset to the outside of the frame with respect to the bearing surface for the bulk material filling as well as being arranged at an angle thereto.

Such building elements are known in the art from the German patent specifications laid open to public inspection Nos. 31 03 849, 31 06 486 and 24 20 173. These building elements are all in need of improvement with regard to the combination of their carrying capacity and their bond strength in relation to mass and construction cost, as well as with regard to their retaining and securing ability with respect to the bulk material filling.

According to a first aspect of the invention, there is provided a frame-shaped building element for supporting grid walls with a bulk material filling, comprising at least two beams arranged at an angle to one another, and connected in a form-locking or material-locking manner, one of which is constructed as a longitudinal beam extending substantially parallel to the wall plane and comprising at least two profile legs arranged at an angle to one another, the first of these profile legs forming at least one bearing surface for the bulk material filling covering substantially. the central part of the longitudinal beam's cross-section, and the second of these profile legs forming a retaining surface for the bulk material filling facing the inside space of the frame, offset to the outside of the frame with respect to the bearing surface for the bulk material filling, and arranged at an angle, characterised in that the first profile leg has a wedge-shaped cross-section with a cross-sectional height which increases evenly from the out-side inwards.

Another aspect of the invention provides a frame-shaped building element for supporting grid walls with a bulk material filling, comprising at least two beams arranged at an angle to one another, and connected in a form-locking or material-locking manner, one of the beams being constructed as a longitudinal beam extending substantially parallel to the wall plane and comprising at least two profile legs arranged at an angle to one another, wherein the first of these profile legs forms at least one bearing surface for the bulk material filling, characterised in that the second profile leg is arranged offset towards the inside of the frame and extends from this bearing surface upwardly, and comprises at least one retaining surface for the bulk material filling facing away from the inside space of the frame and extending upwardly therefrom at an angle.

A further aspect of the invention provides a building element for supporting grid walls with a bulk material filling, designed as a profile beam comprising at least two profile legs, arranged at an angle to one another, the first of which has at least one bearing surface for the bulk material filling and the second at least one retaining surface for the bulk material filling arranged at an angle to the bearing surface for the bulk material filling, characterised in that the first profile leg has a triangular cross-section with a cross-sectional height which increases evenly from the point where it is joined to the second profile leg.

Yet another aspect of the invention provides a building element for supporting grid walls with a bulk material filling, constructed at a profile beam with at least two profile legs arranged at an angle to one another, the first of which legs comprises at least one bearing surface for the bulk material and the second at least one retaining surface for the bulk material filling arranged at an angle to the bearing surface for the bulk material filling, according to any one of claims 24 to 29, characterised in that the second profile leg has a wedge-shaped or triangular cross-section with a cross-sectional width which increases from the point where it is joined to the first profile leg.

Another aspect of the invention provides a building element for supporting grid walls with a bulk material filling, constructed as a profile beam comprising at least one surface provided for bearing, retaining or supporting the bulk material filling, characterised by at least three profile legs or profile leg sections, angled alternately in opposite directions to one another around the longitudinal axis of the beam.

A further aspect of the invention provides a building element for supporting grid walls with a bulk material filling, constructed as a profile beam comprising a plurality of profile legs arranged at an angle to one another, characterised by at least one T-shaped or cross-shaped profile section with at least one pair of at least approximately aligned profile legs.

A still further aspect of the invention provides a building element for supporting grid walls with a bulk material filling, constructed as a profile beam comprising a plurality of profile legs arranged at an angle to one another, of which at least a first one forms a bearing surface for the bulk material filling, characterised by at least one second profile leg which is formed onto the first profile leg parallel to its longitudinal direction and at a distance from the two longitudinal end edges thereof.

Another aspect of the invention provides a building element for supporting grid walls with a bulk material filling, constructed as a profile beam with at least one bearing surface for the bulk material, characterised in that the cross-sectional height of the profile beam measured transversely to the bearing surface for the bulk material filling, at least over the central part of the cross-sectional width, increases from the two outsides towards the middle.

Yet another aspect of the invention provides a building element for supporting grid walls with a bulk material filling, constructed as a profile beam with at least one bearing surface for the bulk material filling, characterised by at least two bearing surfaces for the bulk material filling arranged at an obtuse angle to one another.

BRIEF DESCRIPTION OF THE DRAWINGS

FIG. 1A is a partial cross-section of a second embodiment of a grid structure with a form-locking connection between a longitudinal beam and a cross beam;

FIG. 1B shows a variation of a longitudinal beam in an axial view;

FIG. 1C shows a cross-section of a longitudinal beam with enforcing armatures within a frame-like unitary grid structure element in a scale enlarged with respect to FIG. 1;

Figure 1:
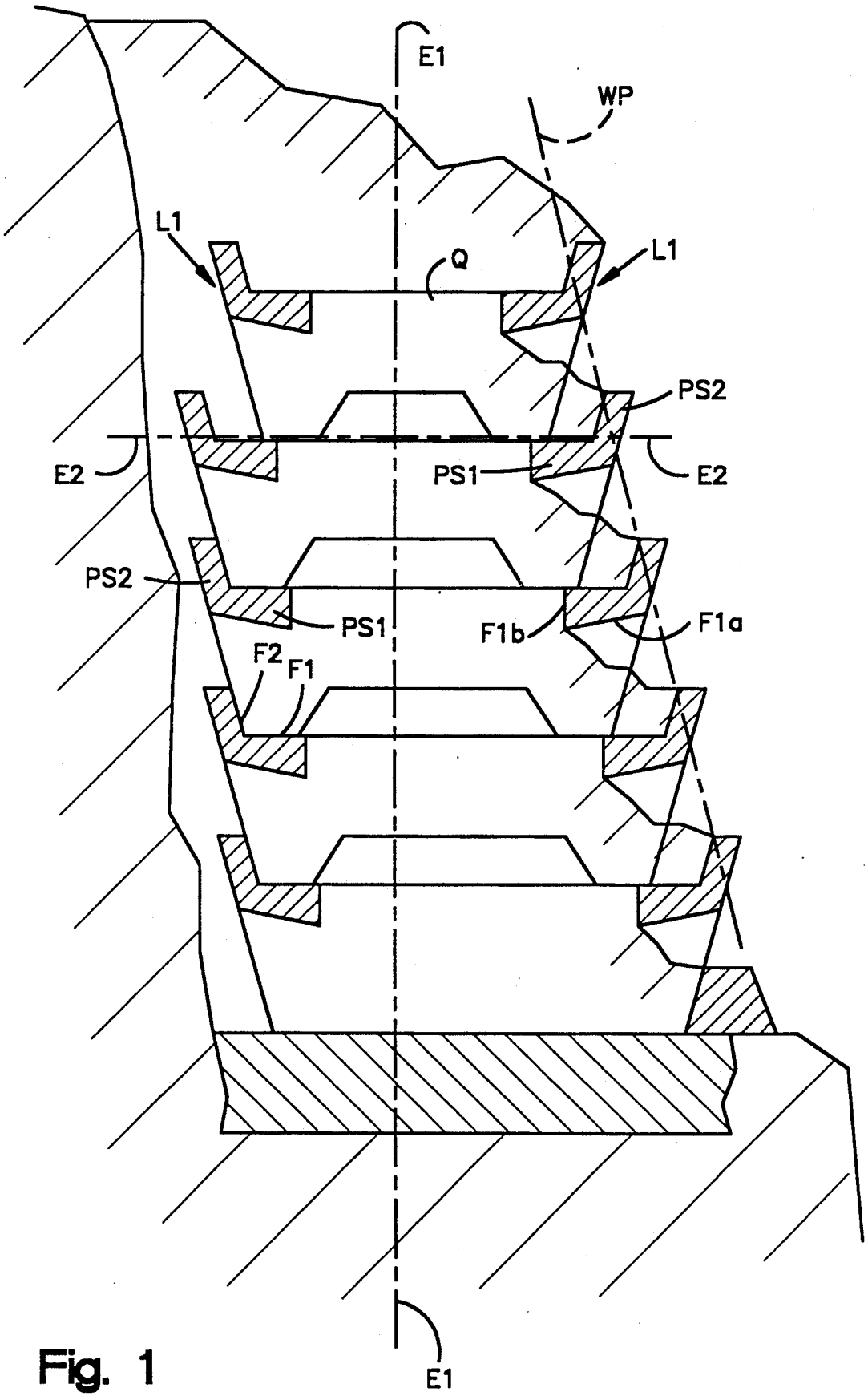
FIG. 1 is a cross-section of a first embodiment of a supporting wall with a grid structure consisting of frame-like, unitary elements superimposed on each other, and with a bulk material filling.

The supporting grid wall according to FIG. 1 serves as a slope retaining wall and consists of frame-shaped building elements placed on top of one another. Each consists of two front and rear longitudinal beams L1 and at least one cross beam Q. The longitudinal and cross beams are arranged in the usual manner at an angle to one another, preferably a right angle, and are made, for example, in one piece from concrete. A material-locking or form-locking connection between the longitudinal and cross beams subsequent to a separate production thereof may also be adopted, e.g., by toothed elements like the slanting bearing surface FA1 of longitudinal beam L1A of the embodiment according to FIG. 1A, which surface cooperates with a corresponding recess of cross beam Q1A. Appropriate bolting or clamping means may, in principle, also be considered.

Important according to the overall characteristics of claim 1 is the construction of the longitudinal beams with profile legs PS1 and PS2, the first of which forms a bearing surface F1 and the second a retaining surface F2 for the bulk material filling, PS1 having a wedge-shaped, in this case trapezoidal, cross-section with a cross-sectional height H1 which increases from the outside inwards This cross-section can, in the manner indicated in FIG. 1C, be provided with reinforcing AR1–AR3 in positions which ensure an optimum increase in strength. On the whole, compared to the known building elements, an improved bearing capacity is obtained in relation to the mass, as well as good securing of the bulk material filling and at the same time root space is provided for the usual vegetation of the bulk material slopes exposed at the front of the wall.

Generally the bearing surfaces have a slant adapted to the angle of slope of the bulk material filling in relation to the wall plane E1 and the frame plane E2, in which connection a possible inclination of the former with respect to the vertical must be taken into account, whereas the holding surfaces are arranged more steeply and serve essentially to secure the position of the bulk material filling in the horizontal direction.

The latter also applies to the supporting surfaces F1b formed on the inside of the profile legs PS2, which assist uniform compaction of the filling. Preferred values for the angle arrangement between the bearing surface, supporting surface and the bottom base surface F1a can be noted from the characterising part of claims 2 to 8 as well as 14 to 18. According to claim 24 and the associated dependent claims, it is also possible to use the longitudinal beams L1 as separate building elements for installation with cross beams in the supporting grid.

The embodiment according to FIG. 1A is characterised by the outwardly declining slant of the bearing surface FA1. For the last mentioned mode of installation of the longitudinal beams L1A, this provides the advantage that their position can be secured against outward shifting under the effect of the filling pressure by means of corresponding recesses in the cross beam O1A resting thereon. The longitudinal beam L1B according to FIG. 1B is characterised by a greater horizontal bending strength of the profile leg PS2B due to the fact that its cross-sectional width B1 increases towards the top at a comparatively small cross-sectional area. The bearing surface F1 on the profile leg PS1B may, as indicated by dot-dash lines, also be made without a slant and the profile leg itself may have the same thickness all over.

FIG. 1C shows the particularly advantageous embodiment of the free longitudinal edge LK1 according to claims 10 and 11, which helps to avoid damages to the sensitive edge region under rough conditions of use.

FIGS. 2 to 5 and 7 to 10 show embodiments of frame-shaped building elements having the characteristics of claim 12 with a second profile leg which is offset inwards in relation to the first profile leg, which forms a retaining surface facing the bulk material filling on the bearing surface and an opposite supporting surface. This design has the special advantage that it prevents the filling from sliding in the direction of the inside space of the frame when settlement takes place in the latter region, as well as that of an improved compactability of the filling material in the inside space as a result of the abutment effect of the supporting surfaces. The inside profile legs also easily permit desired separation of the valuable filling material with a high humus content in the planting region from the coarse filling material in the inside space.

Figure 4:
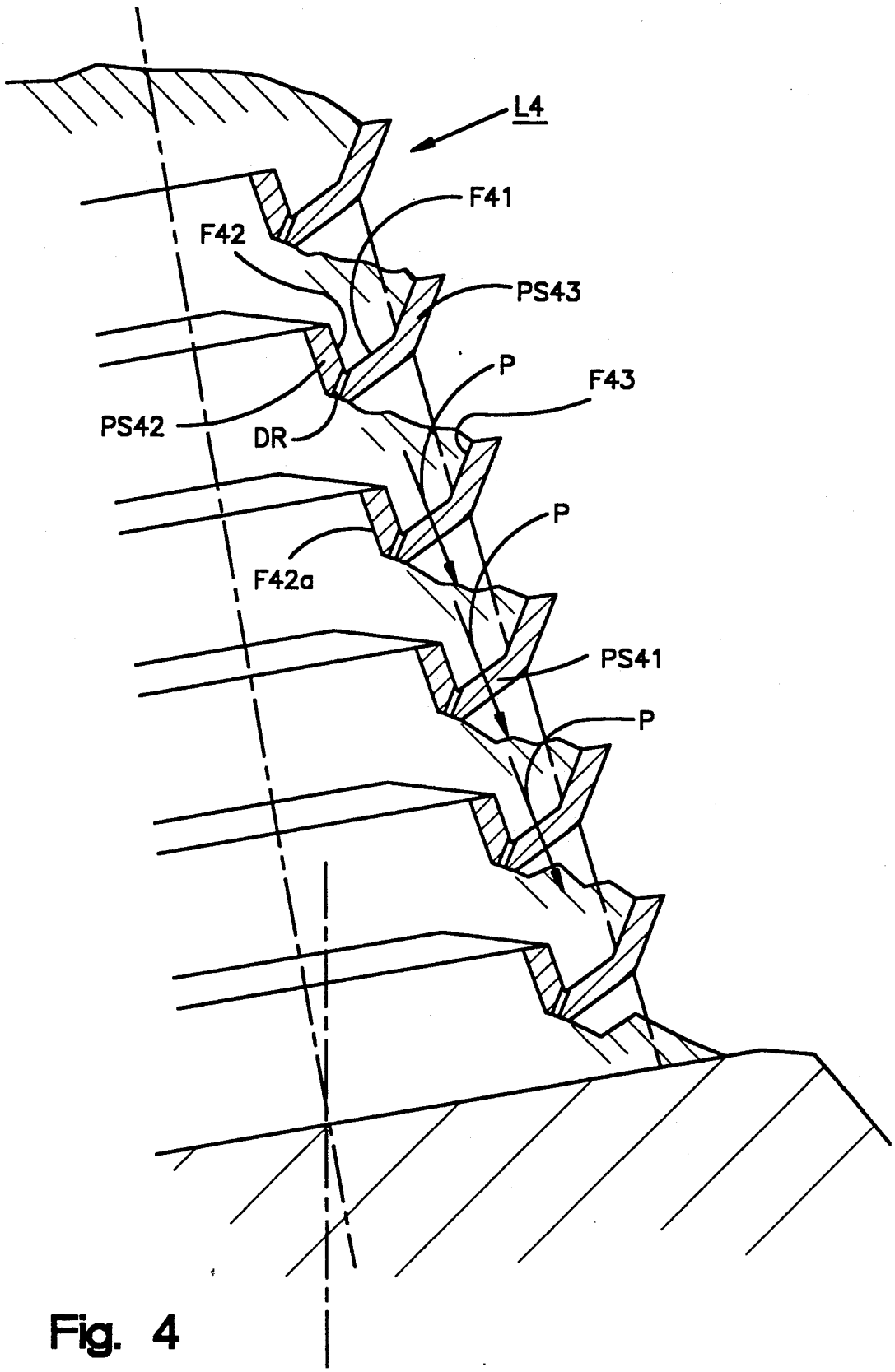
FIG. 4 shows in cross-section a second embodiment of a grid structure wall with a bulk material filling and frame-like, unitary grid elements.
Figure 5:
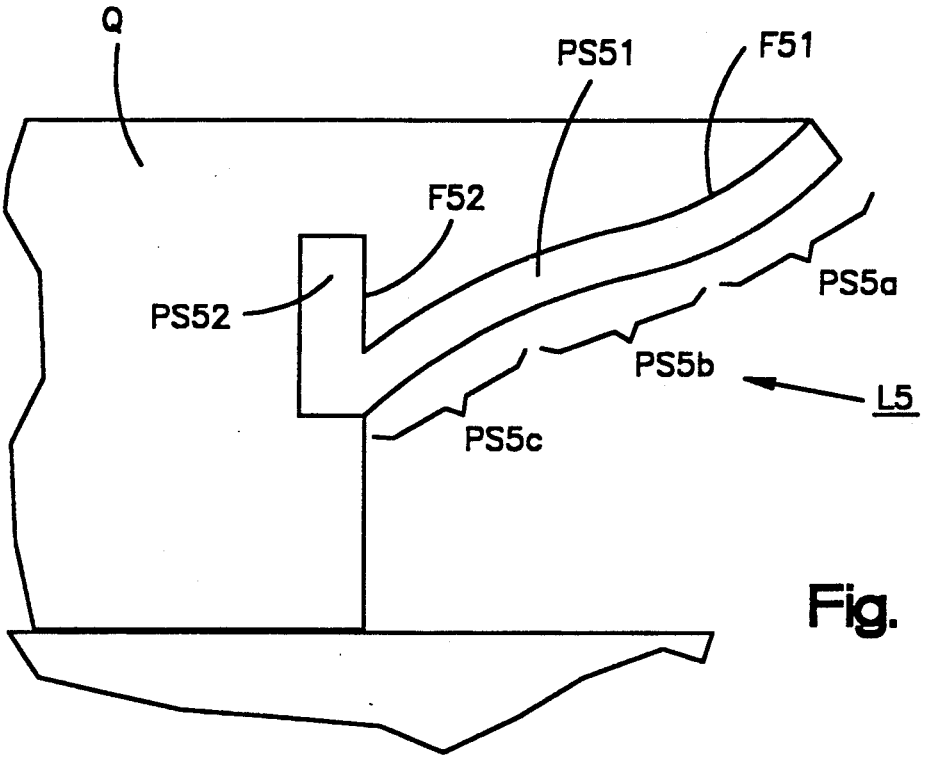
FIGS. 5, 6, 6A, 7 and 8 show in partial cross-section further variations of longitudinal beams being part of frame-like, unitary grid elements.

According to FIG. 4 it is possible to combine the advantages of the two constructions with inside and outside profile legs, ensuring a particularly high bending strength with respect to the resultant filling forces P.

Figure 2:
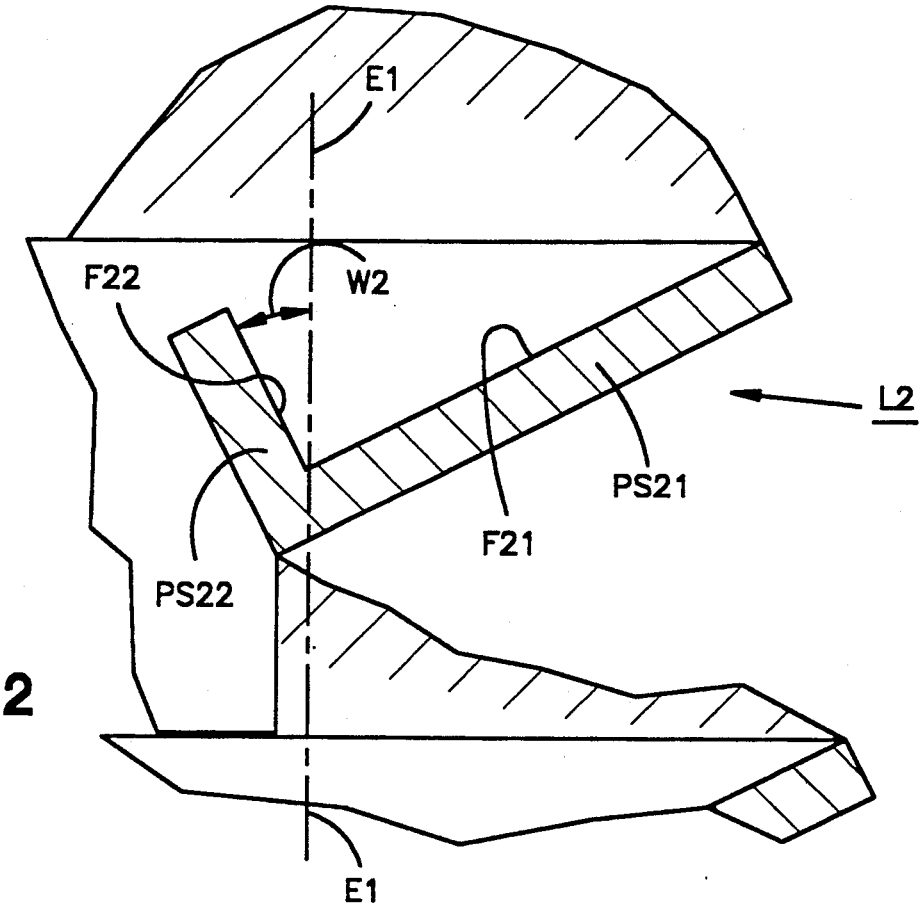
FIGS. 2 and 3 show further embodiments of unitary grid elements by partial cross-section through a longitudinal beam.
Figure 3:
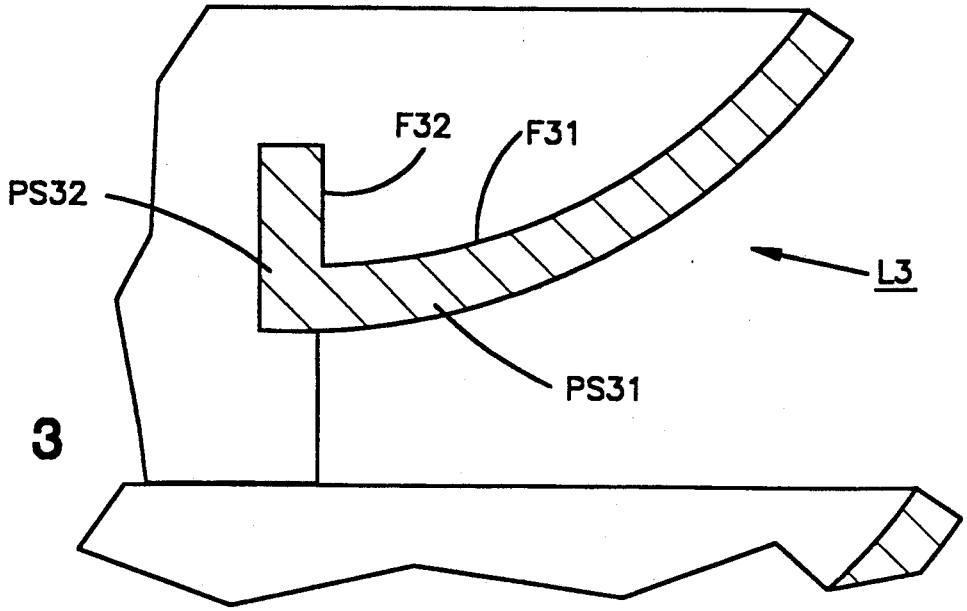
Figure 6:
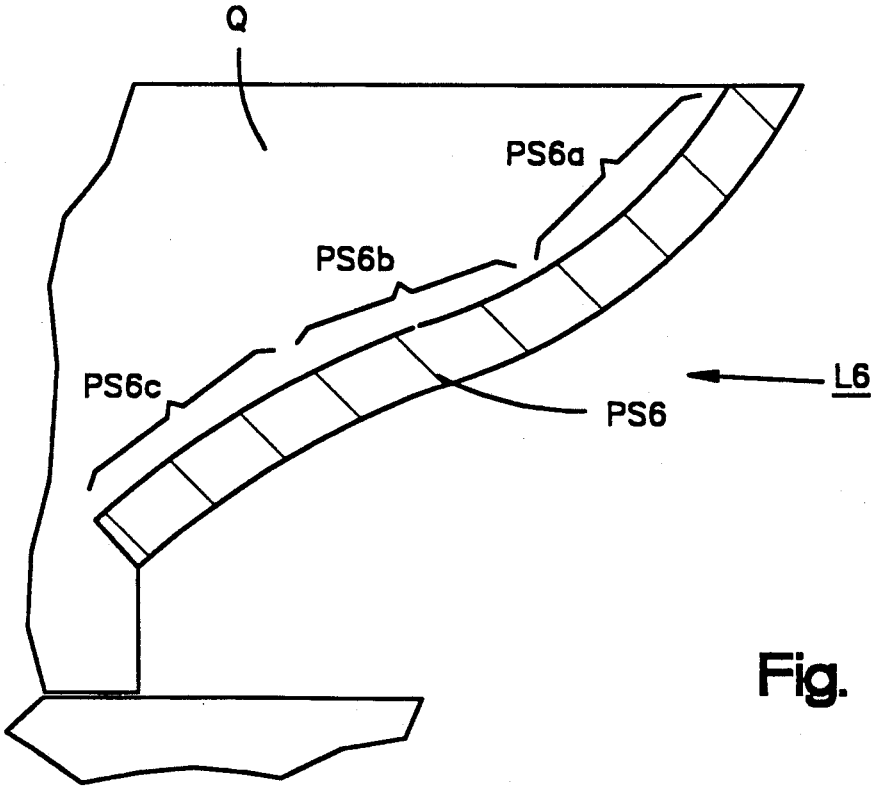
Figure 6A:
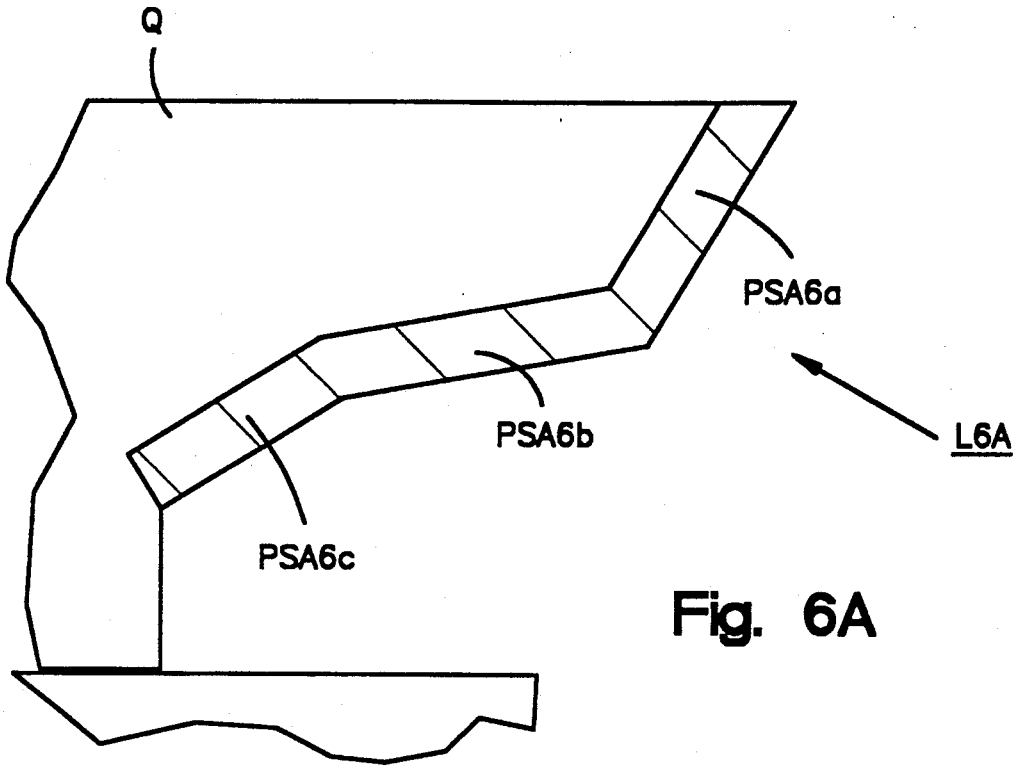
Figure 7:
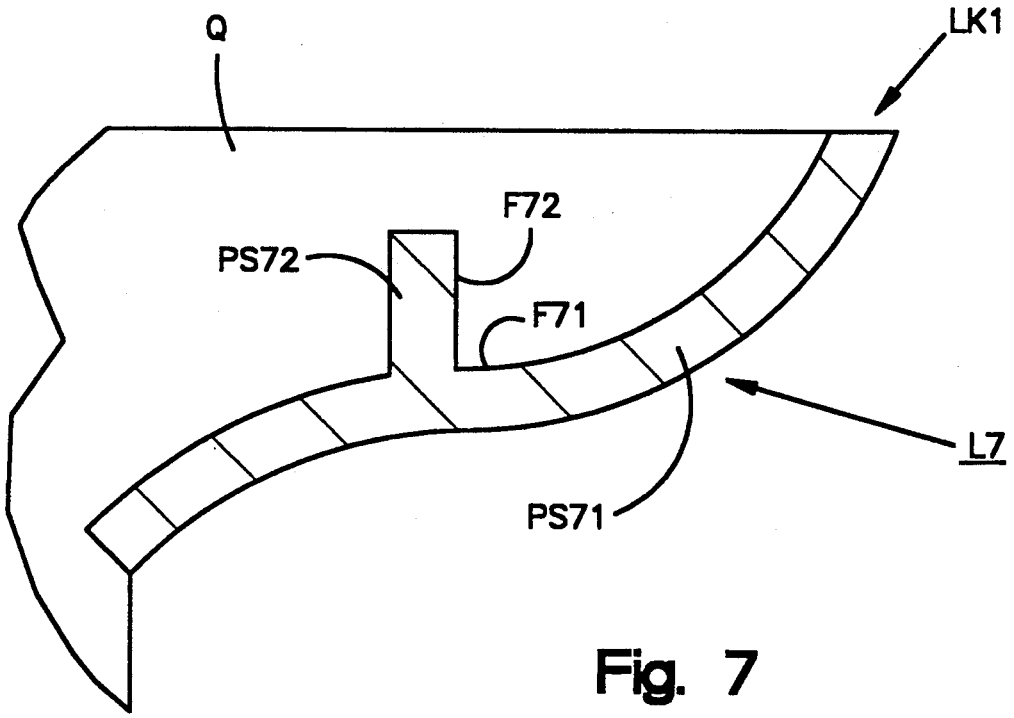

Particularly simple and easy to produce designs are obtained according to the examples illustrated in FIGS. 2 and 3, wherein the concave, generally cylindrical shape of the bearing surface according to FIG. 3 ensures a high bending resistance moment and an increase in the root space whilst providing satisfactory aesthetic appearance of the front of the wall. The latter also applies above all to the embodiments according to FIG. 5, 6 and 7 comprising profile legs or profile leg sections angled alternately in opposite directions and corresponding bearing surface and outside surface sections according to the characteristics of claim 31. According to FIG. 6 and 6A one can, if need be, dispense with special profile legs with retaining or support surfaces when the properties of the filling material and the conditions of use of the structure permit this. The advantage lies in the more simple shape and the fact that they can be produced more easily. With this one generally uses, as indicated in FIG. 6A, a bearing surface for the bulk material filling which has a relatively small slant in relation to the horizontal. FIG. 7, on the other hand, shows a design which is good with regard to strength, the retaining of the filling, the root space and the outer appearance, comprising an upwardly directed rib-shaped leg PS72 formed on in the central region of the profile leg PS71. Particularly advantageous in this connection is also the fact that the curvature of the profile leg PS71—provided as an element having the same thickness all over—increases progressively towards the free longitudinal edge LK1, as indicated in claim 22.

Figure 8:
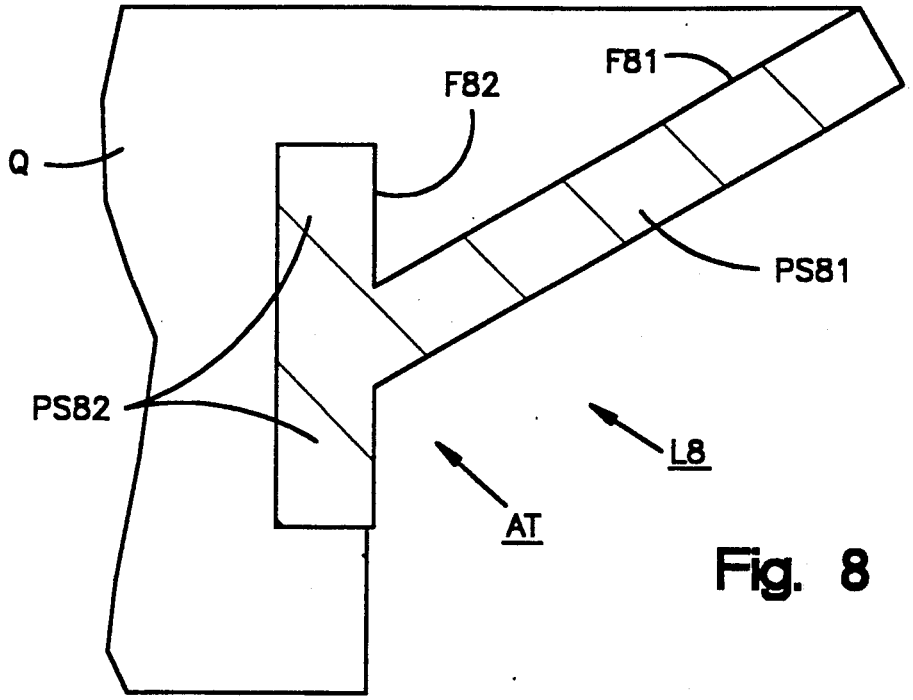
Figure 8A:
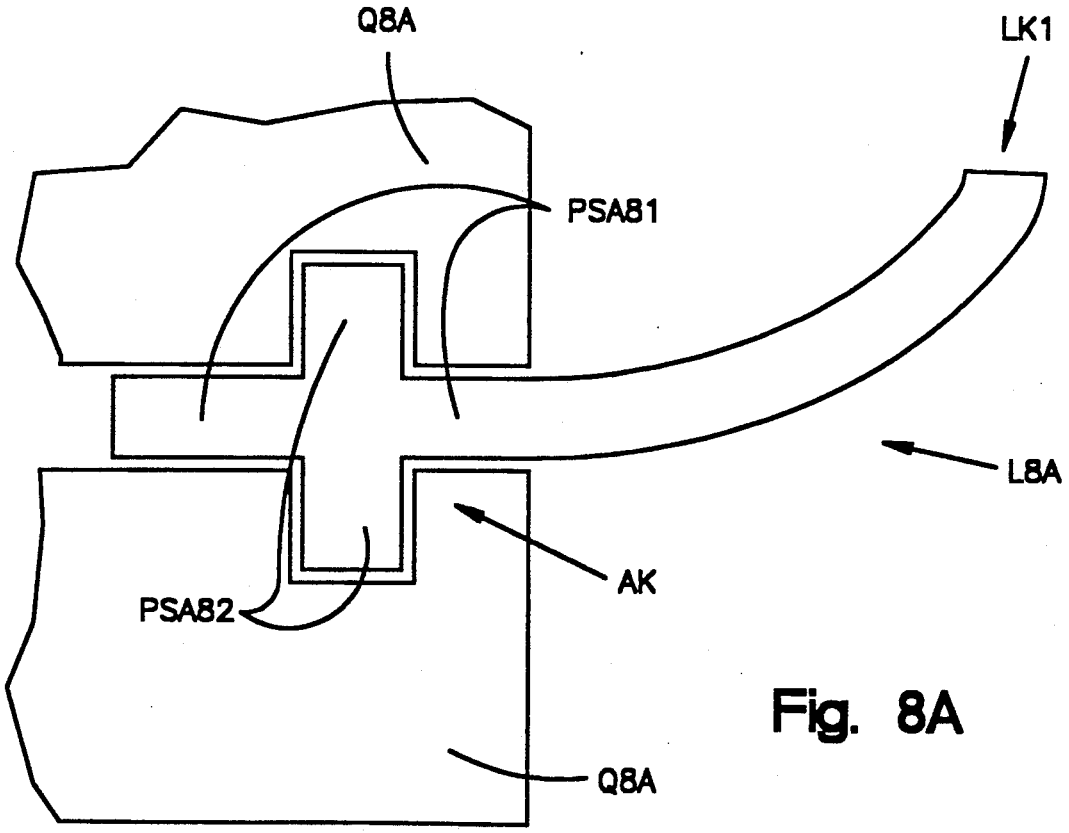
FIGS. 8A, 9, 10, 11 and 12 show further variations of longitudinal beams designed to be incorporated in a grid structure by means of form-locking connections to corresponding cross beams, all in partial cross-sectional view.
Figure 9:
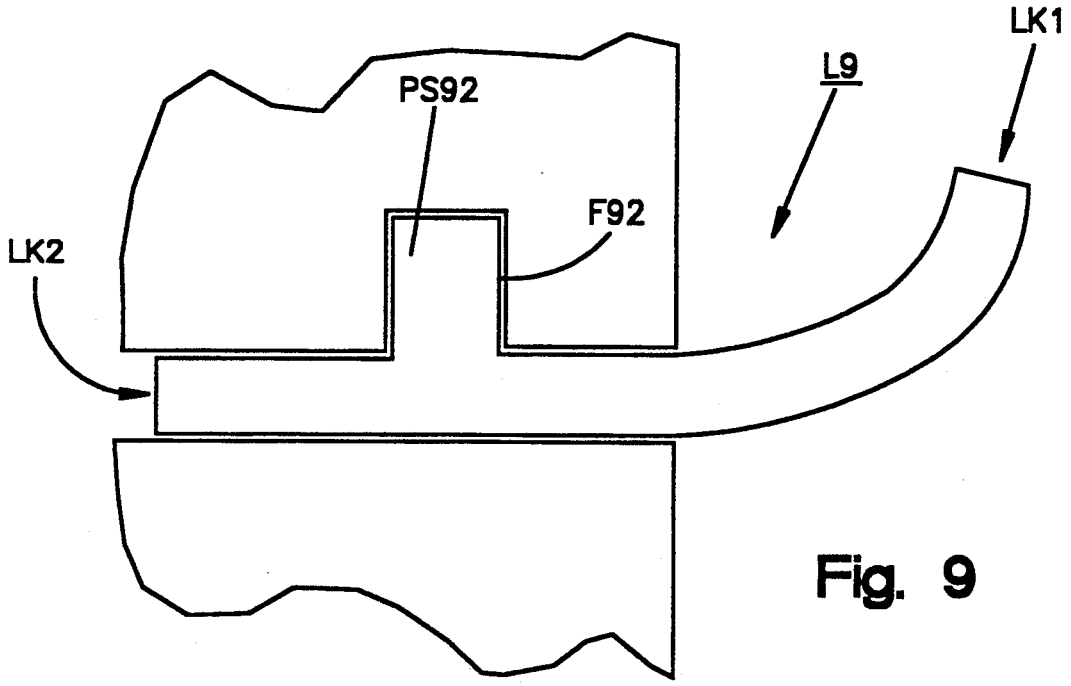
Figure 10:
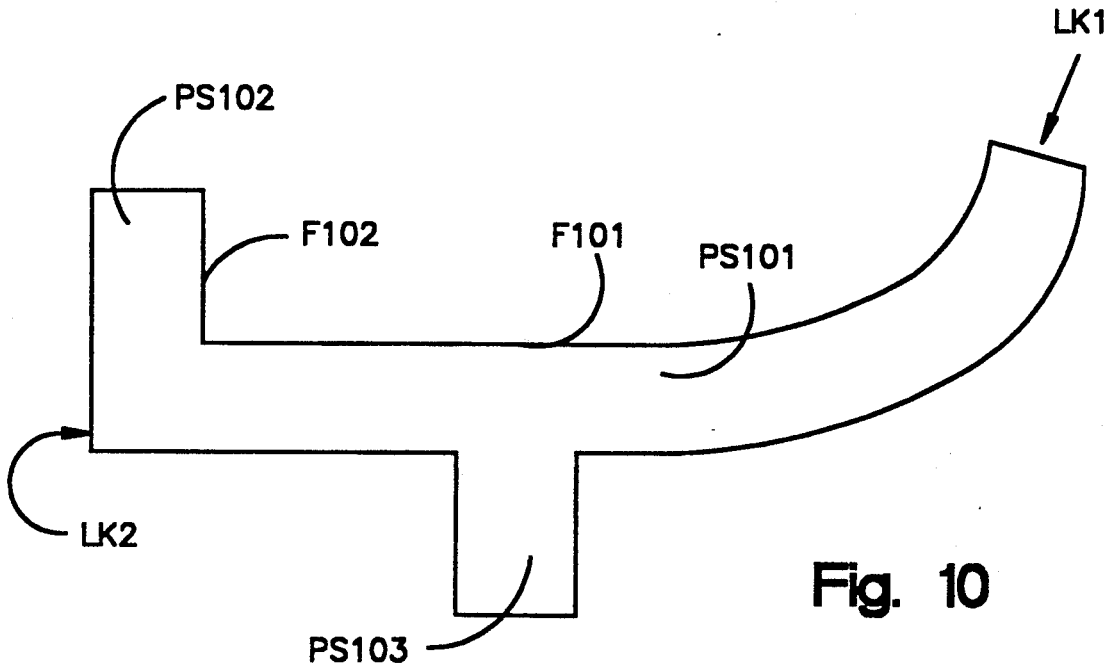

The embodiment according to FIG. 8 is characterised by a simple shape whilst ensuring a high bending strength as a result of a T-shaped profile cross-sectional area AT with aligned profile legs PS82, as indicated in claim 33. The embodiment according to FIG. 8A displays a cross-shaped profile section with an even greater increase in the strength of the beam. In addition this embodiment is particularly suitable for the separate installation of the longitudinal beam L8A in the supporting grid, with form-locking securing of its position by the cross beam Q8A which is provided with recesses corresponding to the opposite profile legs PSA82.

The embodiments according to FIG. 8A to 10 comprise rib profile legs PSA82, PS92 and PS103 respectively, formed transversely onto a first bearing surface profile leg, and arranged at a distance from the two longitudinal end edges LK1 and LK2 of the beam. All these embodiments have good bending strength, the ease of providing vegetation, and a simple securing of their position when installed separately, as explained in connection with FIG. 8A.

Figure 11:
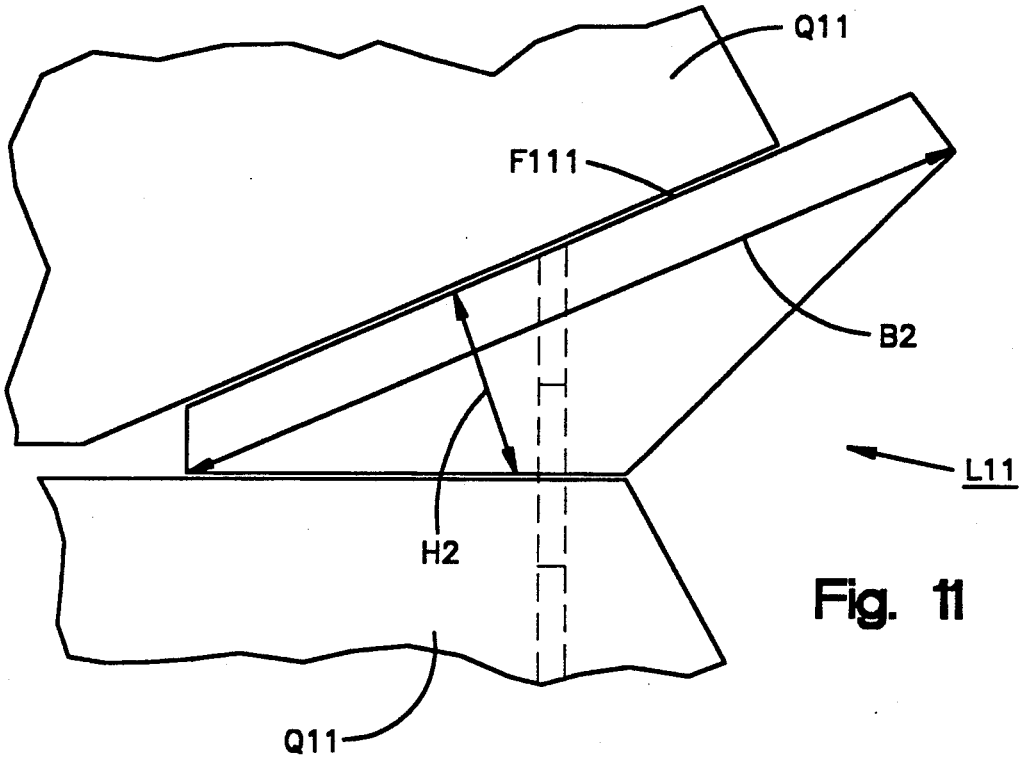
Figure 12:
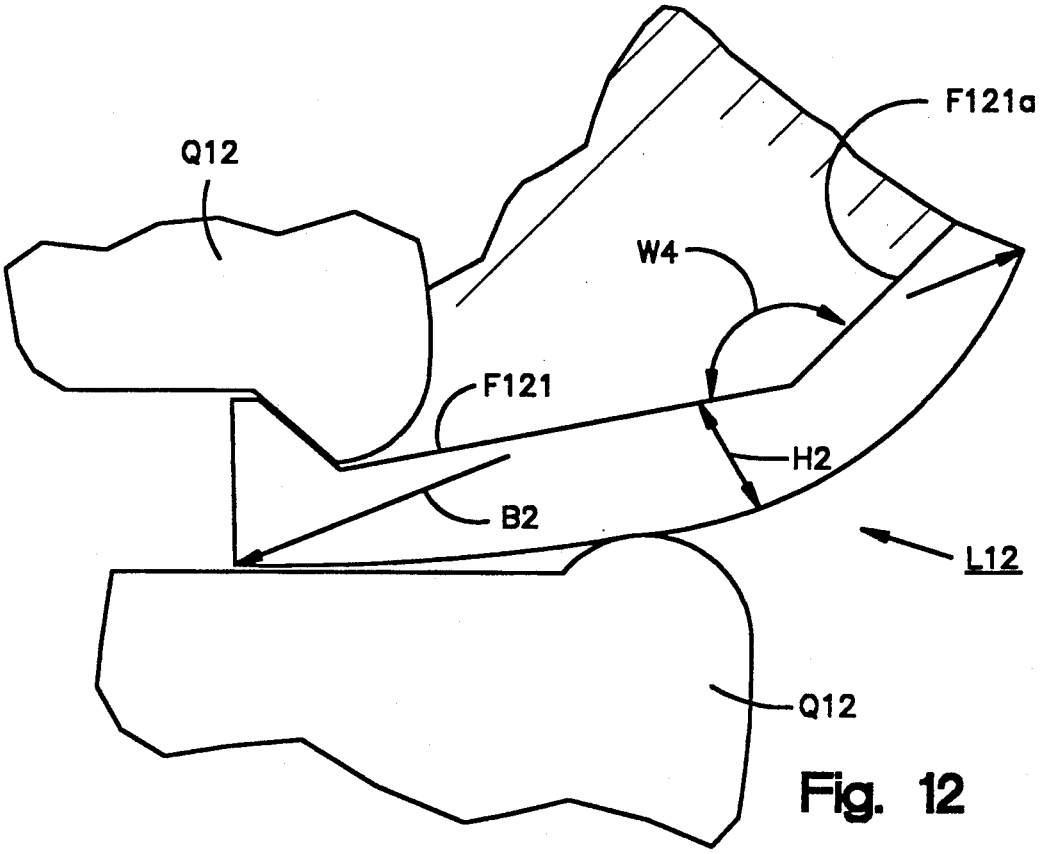

The characteristics of claims 35 to 39 are illustrated in the embodiments according to FIG. 11 and 12. These are very simple and compact, as well as easy to produce cross-sectional shapes of the longitudinal beams L11 and L12, in the first case, however, at the expense of the root space, but with a particularly high bending strength. The securing of their position when installed separately as shown in FIG. 11 is ensured by the indicated anchoring pins in vertical recesses of the cross beam Q11 and the longitudinal beam L11, The construction according to FIG. 12 manages without such anchoring pins, seeing that ribs and beads provided on the beams result in a form-locking horizontal and vertical securing. The measures indicated in claim 35 and above all in claim 36 result in shaping of the longitudinal beam approximately as a bending beam subjected to the same bending stress over the entire cross-sectional width under the weight of the bulk material filling lying on the bearing surfaces. In this connection the characteristics of claims 38 and 39 also permit a relatively large root space. The installation in the supporting grid is advantageously simple.

Figure 13:
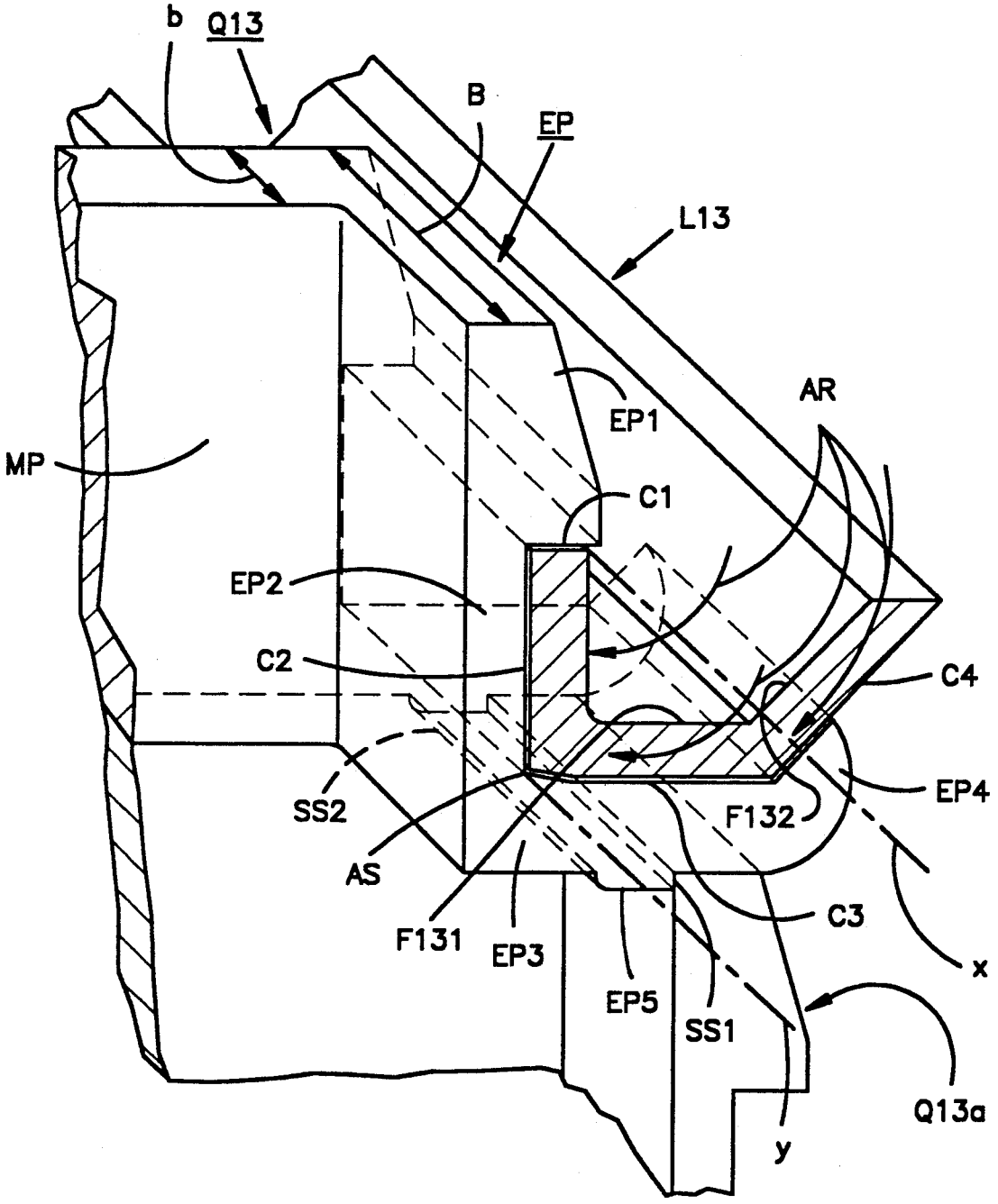
FIG. 13 shows a perspective and partially sectional view of a form-locking connection between a longitudinal and cross beam in a mounted state within a grid structure.

A further embodiment of a multi-part building element according to the invention is shown in FIG. 13 in a perspective partial view. i.e. in a view on the region of connection between an end portion of a cross beam Q13 and a longitudinal beam L13. The cross beam Q13 comprises a middle portion MP (partially shown in FIG. 13) of smaller cross-sectional breadth b and an end portion EP of greater cross-sectional breadth B. End portion EP is shaped to form a recess or hole AS, which is open over a portion of its circumference for receiving the longitudinal beam L13 and to form a form-locking connection therewith. For this purpose the contour of recess AS is adapted to a corresponding part of the cross-sectional contour of the longitudinal beam L13, i.e. in the example to the contour sections C1, C2, C3 and to the lower part of section C4. The end portion EP of the longitudinal beam L13 accordingly comprises an upper locking portion EP1 overlapping the contour section C1 and a support portion EP3 extending below the contour section C3 so as to secure the longitudinal beam L13 against tilting in clockwise direction about its longitudinal axis y (with reference to the view of FIG. 13) under the weight of the bulk filling resting on the bearing surfaces F131 and F132. Furthermore, holding portions EP2 and EP4 cooperating with contour sections C2 and C4 are provided to secure beam L13 against horizontal displacement. At the lower surface of end portion EP a further locking portion EP5 is provided in the form of a projecting rib extending in the longitudinal direction y of beam L13 and cooperating with correspondingly shaped surface sections SS1 and SS2 of a further cross beam Q13a located below and bearing the cross beam Q13, the latter thus being also secured against horizontal displacement and rotation.

Moreover, it is essential that the contour of recess AS is shaped in such a manner that the longitudinal beam L13 can be swung into its form-locking seat in the recess AS by firstly abutting against locking portion EP1 with its contour section C1 in a position rotated somewhat in relation to the position shown in FIG. 13 in the anticlockwise direction, and then being rotated in the clockwise direction according to arrows AR about axis X formed by the abutment between contour section C1 and locking portion EP1. This is a highly simple and comfortable method of mounting the longitudinal beam on the cross beam and leads to a fully form-locking connection between both beams against all displacements and rotations, except only a displacement of the longitudinal beam in its longitudinal direction and a re-rotation about axis X in the anticlockwise direction, both these movements in relation to the cross beam being without relevance in the mounted state due to the action of the weight of the longitudinal beam and of the bulk filling resting thereon.

Furthermore, the provision of an end portion EP of comparatively great breadth B on the cross beam Q13 leads to an enhanced form-locking stability in the connection between both beams against bending and torsion moments. In this respect even a favourable approximation to the conditions of a material-locking or unitary connection between the beams can be obtained. In this context it is further of essential importance that the enhanced connection stability is obtained without inproportioned mass and weight as well as expenses for the middle portion of the cross beam, this advantage being due to the relation of breadths b and B in the cross beam portions MP and EP as explained above. In view of the production expenses it is of great importance to have the over-all contour surfaces of cross beam Q13 shaped prismatic, i.e. substantially in parallel to axis y, including the surfaces of recess AS. This shape makes it possible to readily mould the cross beam from concrete or similar materials including a suitable armature by casting or pressing the material into a simple and preferably undivided and/or open mould. On principle these advantages are obtainable with closed recess shapes also, in which a longitudinal beam has to be shifted-in for mounting.

I claim:

1. A wall structure for forming a substantially planar grid wall for receiving and supporting a bulk material filling, comprising at least one first structural element extending substantially at an angle, particularly transverse, to the wall plane and at least one second structural element extending substantially parallel to the wall plane, said first element including means defining at least one recess for embracing said second element at least partially along the cross-sectional contour thereof in a plane transverse to the wall plane so as to connect and secure together said first and second elements in a predetermined relative position in said structure, wherein at least one connection portion of said first element comprising said recess is substantially larger in a first cross-sectional dimension measured in a first direction parallel to the wall plane, in comparison to a second cross-sectional dimension of the first element measured in a second direction which is parallel to said first direction but spaced apart from said connection region of said first element, in which said first element is a transverse beam and said second element a longitudinal beam with regard to the wall plane, said first cross-sectional dimension being the breadth of said transverse beam in said region comprising said recess measured in parallel to said longitudinal beam and said second cross-sectional dimension being the minimum breadth of said first element measured in parallel to said longitudinal beam.

2. A structure according to claim 1 in which said connection portion of said first element is substantially prismatic in shape, the outer surface of said connection portion and the surface of said hole or recess being defined by generatrixes which are all substantially parallel.

* * * * *